US012320044B2

(12) United States Patent
Padgett et al.

(10) Patent No.: US 12,320,044 B2
(45) Date of Patent: Jun. 3, 2025

(54) RECYCLABLE COOLING FABRIC

(71) Applicant: CULP, INC., Stokesdale, NC (US)

(72) Inventors: Michael A. Padgett, Tobaccoville, NC (US); Billy J. Garcia, Glenview, IL (US); Angel Hernandez, Winston Salem, NC (US); Jeffrey Charles Veach, High Point, NC (US)

(73) Assignee: CULP, INC., Stokesdale, NC (US)

( * ) Notice: Subject to any disclaimer, the term of this patent is extended or adjusted under 35 U.S.C. 154(b) by 412 days.

(21) Appl. No.: 17/688,566

(22) Filed: Mar. 7, 2022

(65) Prior Publication Data

US 2023/0279588 A1 Sep. 7, 2023

(51) Int. Cl.
*D04B 21/16* (2006.01)
*D04B 1/02* (2006.01)

(52) U.S. Cl.
CPC ..... *D04B 21/165* (2013.01); *D04B 1/02* (2013.01); *D10B 2401/04* (2013.01)

(58) Field of Classification Search
CPC ..... D04B 1/123; D04B 1/02; D04B 21/165; D04B 21/16; D04B 21/207; D04B 21/08; D10B 2401/04; D10B 2331/10; D10B 2331/04; D10B 2501/02; B32B 5/026; B32B 5/26; B32B 2250/03; B32B 2250/20; B32B 2307/726; B32B 2307/724; B32B 2437/00
See application file for complete search history.

(56) References Cited

U.S. PATENT DOCUMENTS

2019/0017200 A1* 1/2019 Alletto, Jr. ..... D02G 3/40
2020/0307150 A1* 10/2020 Wang ..... B32B 5/026

* cited by examiner

*Primary Examiner* — Camie S Thompson
(74) *Attorney, Agent, or Firm* — Moore & Van Allen PLLC

(57) ABSTRACT

A recyclable cooling fabric is provided. The recyclable cooling fabric includes a first surface and a second surface opposite the first surface. The first surface and the second surface include a plurality of face yarns. The plurality of face yarns includes polyethylene, nylon, and recycled polyester. A plurality of inlay yarns is disposed between the first surface and the second surface. Methods of manufacturing the recyclable cooling fabric, and mattresses utilizing the recyclable cooling fabric as mattress ticking are also provided.

20 Claims, 3 Drawing Sheets

RECYCLABLE COOLING FABRIC

FIELD

The presently-disclosed invention relates generally to textiles and, more particularly, to recyclable cooling fabric and methods for making the same.

BACKGROUND

Cooling materials and fabrics have increased in popularity in recent years, particularly with regard to mattresses, mattress covers, mattress ticking, mattress pads, sheets, duvets, comforters, and the like. Indeed, it has been found that sleep quality is improved when the body is kept at cooler temperatures. Many of these cooling materials and fabrics, however, rely on plastics and other synthetic materials that are not readily decomposable or biodegradable such that they remain in landfills after disposal and are not good for the environment.

Accordingly, there is a need for fabrics that provide cooling properties while also being environmentally friendly.

BRIEF SUMMARY

One or more embodiments of the invention may address one or more of the aforementioned problems. Certain embodiments according to the invention provide fabrics having cooling properties that are also environmentally friendly. In particular, according to a first aspect, a recyclable cooling fabric is provided. The recycling cooling fabric comprises a first surface and a second surface opposite the first surface. The first surface and the second surface comprise a plurality of face yarns, and a plurality of inlay yarns are disposed between the first surface and the second surface. The plurality of face yarns comprises polyethylene, nylon, and recycled polyester.

According to certain embodiments, the plurality of inlay yarns may comprise at least one of virgin polyester, recycled polyester, wool, polyethylene, or any combination thereof.

According to certain embodiments, the recyclable cooling fabric may comprise from about 20 to about 50 wt % of the plurality of inlay yarns. In some embodiments, the recyclable cooling fabric may comprise from about 20 to about 50 wt % of the plurality of face yarns.

According to certain embodiments, the recyclable cooling fabric may further comprise a phase change material coated on at least one of the first surface and the second surface of the recyclable cooling fabric.

According to certain embodiments, the recyclable cooling fabric may comprise a three-part knit. In some embodiments, the recyclable cooling fabric may comprise a jacquard knitted fabric.

According to certain embodiments, the recyclable cooling fabric may have a thermal effusivity from about 85 to about 1600 $Ws^{1/2}/m^2K$. In some embodiments, the recyclable cooling fabric may have a thermal effusivity from about 135 to about 285 $Ws^{1/2}/m^2K$.

According to certain embodiments, the recyclable cooling fabric may have a fabric weight from about 200 to about 450 GSM.

In another aspect, a method of manufacturing a recyclable cooling fabric is provided. The method comprises knitting a plurality of face yarns into a first surface and a second surface opposite the first surface, and knitting a plurality of inlay yarns between the first surface and the second surface. The plurality of face yarns comprise polyethylene, nylon, and recycled polyester.

According to certain embodiments, the method may further comprise coating a phase change material on at least one of the first surface and the second surface. In some embodiments, coating the phase change material may comprise applying the phase change material via a pad bath. In other embodiments, coating the phase change material may comprise roll coating the phase change material.

According to certain embodiments, knitting the plurality of face yarns and knitting the plurality of inlay yarns may comprise a three-part knit. In some embodiments, knitting the plurality of face yarns and knitting the plurality of inlay yarns comprises a jacquard knit.

According to certain embodiments, the recyclable cooling fabric may comprise from about 20 to about 50 wt % of the plurality of inlay yarns. In some embodiments, the recyclable cooling fabric may comprise from about 20 to about 50 wt % of the plurality of face yarns.

According to certain embodiments, the recyclable cooling fabric may have a thermal effusivity from about 135 to about 285 $Ws^{1/2}/m^2K$.

In yet another aspect, a mattress is provided. The mattress comprises a support layer, a comfort layer disposed on a surface of the support layer, and a recyclable cooling mattress ticking enveloping the support layer and the comfort layer. The recyclable cooling mattress ticking comprises a first surface and a second surface opposite the first surface. The first surface and the second surface comprise a plurality of face yarns, and the plurality of face yarns comprise polyethylene, nylon, and recycled polyester. A plurality of inlay yarns are disposed between the first surface and the second surface.

According to certain embodiments, the recyclable cooling mattress ticking may further comprise a phase change material coated on at least one of the first surface and the second surface.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The invention now will be described more fully hereinafter with reference to the accompanying drawings, in which some, but not all embodiments of the inventions are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. As used in the specification, and in the appended claims, the singular forms "a", "an", "the", include plural referents unless the context clearly dictates otherwise.

Definitions

The term "phase change material", as used herein, may generally refer to a substance that releases or absorbs sufficient energy at phase transition to provide useful heat or cooling. The phase transition is typically between solid and liquid but is not so limited.

The term "polyethylene", as used herein, may generally refer to a class of synthetic thermoplastic polymers having variable crystalline structure. For the purposes of this disclosure, polyethylene may refer to one or more of ultra-high-molecular weight polyethylene (UHMWPE), high-density polyethylene (HDPE), linear low-density polyethylene (LLDPE), low-density polyethylene (LDPE), or any combination thereof.

The term "recycled polyester", as used herein, may generally refer to polyester produced from recycled materials, for example, plastic bottles (e.g., water bottles) and textiles. Recycled polyester is in contrast to virgin polyester, which is derived from petroleum in energy-intensive processes.

The term "thermal effusivity", as used herein, may generally refer to the rate at which a material can absorb heat and, more particularly, to the ability of a textile to exchange thermal energy between the skin and the material. For example, the higher the thermal effusivity, the cooler a material feels. Thermal effusivity is measured according to ASTM D7984-16 (quantification thermal performance).

Recyclable Cooling Fabric

Figure 1:
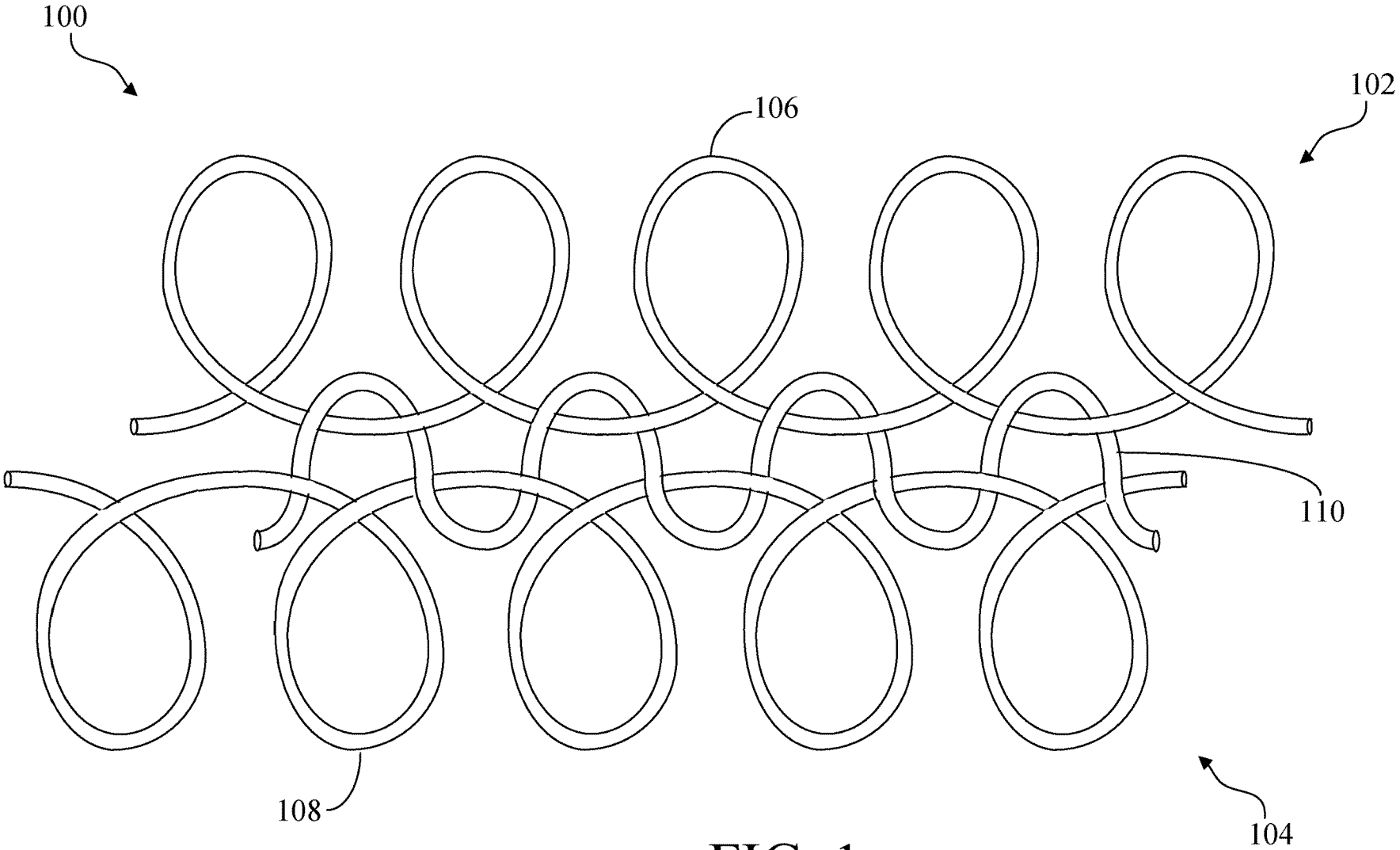
FIG. 1 illustrates a cross-section of a recyclable cooling fabric in accordance with certain embodiments of the invention.

The invention includes, according to certain embodiments, fabrics having cooling properties that are also environmentally friendly. In particular, a recyclable cooling fabric 100 is provided. As shown in FIG. 1, for example, the recyclable cooling fabric 100 includes a first surface 102 and a second surface 104. The first surface 102 and the second surface 104 comprise a plurality of face yarns 106, 108. The plurality of face yarns 106, 108 comprises polyethylene (e.g., UHWMPE, HDPE, LLDPE, or LDPE, as described previously herein), nylon (e.g., nylon 6, recycled nylon 6, etc.), and recycled polyester.

In some embodiments, the plurality of face yarns 106, 108 may comprise a plurality of polyethylene yarns, a plurality of nylon yarns, and a plurality of recycled polyester yarns. In other embodiments, for example, one or more of the plurality of face yarns 106, 108 may comprise a blend of two or more of polyethylene fibers, nylon fibers, and recycled polyester fibers. In this way, the plurality of face yarns 106, 108 may include yarns made only of one type of fiber (e.g., polyethylene, nylon, or recycled polyester), yarns made of multiple types of fibers (e.g., polyethylene and nylon fibers, polyethylene and recycled polyester fibers, nylon and recycled polyester fibers, or polyethylene, nylon, and recycled polyester fibers), or some combination thereof.

In some embodiments, the recyclable cooling fabric 100 may comprise from about 20 to about 50 wt % of the plurality of face yarns 106, 108. In further embodiments, the recyclable cooling fabric 100 may comprise from about 25 to about 35 wt % of the plurality of face yarns 106, 108. As such, in some embodiments, the recyclable cooling fabric 100 may comprise from at least about any of the following: 20, 21, 22, 23, 24, 25, 26, 27, 28, 29, 30, 31, 32, 33, 34, 35, 36, 37, 38, 39, 40, 41, 42, 43, 44, 45, 46, 47, 48, and 49 wt % of the plurality of face yarns 106, 108 and/or at most about 50, 49, 48, 47, 46, 45, 44, 43, 42, 41, 40, 39, 38, 37, 36, 35, 34, 33, 32, 31, 30, 29, 28, 27, 26, 25, 24, 23, 22, and 21 wt % of the plurality of face yarns 106, 108 (e.g., from about 24-42 wt %, from about 30-50 wt %, etc.).

According to certain embodiments, the plurality of face yarns 106, 108 may comprise from about 10 to about 50 wt % polyethylene. In some embodiments, the plurality of face yarns 106, 108 may comprise from about 20 to about 30 wt % polyethylene. As such, in certain embodiments, the plurality of face yarns 106, 108 may comprise from at least about any of the following: 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, and 49 wt % polyethylene and/or at most about 50, 49, 48, 47, 46, 45, 44, 43, 42, 41, 40, 39, 38, 37, 36, 35, 34, 33, 32, 31, 30, 29, 28, 27, 26, 25, 24, 23, 22, 21, 20, 19, 18, 17, 16, 15, 14, 13, 12, and 11 wt % polyethylene (e.g., from about 15-44 wt % polyethylene, from about 20-32 wt % polyethylene, etc.).

In some embodiments, the polyethylene may have a thermal conductivity from about 200 to about 500 $Ws^{1/2}/m^2K$. In further embodiments, the polyethylene may have a thermal conductivity from about 300 to about 400 $Ws^{1/2}/m^2K$. As such, in certain embodiments, the polyethylene may have a thermal conductivity from at least about any of the following: 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, 445, 450, 455, 460, 465, 470, 475, 480, 485, 490, and 495 $Ws^{1/2}/m^2K$ and/or at most about 500, 495, 490, 485, 480, 475, 470, 465, 460, 455, 450, 445, 440, 435, 430, 425, 420, 415, 410, 405, 400, 395, 390, 385, 380, 375, 370, 365, 360, 355, 350, 345, 340, 335, 330, 325, 320, 315, 310, 305, 300, 295, 290, 285, 280, 275, 270, 265, 260, 255, 250, 245, 240, 235, 230, 225, 220, 215, 210, and 205 $Ws^{1/2}/m^2K$ (e.g., from about 235-400 $Ws^{1/2}/m^2K$, from about 300-405 $Ws^{1/2}/m^2K$, etc.).

In certain embodiments, the polyethylene may have a tenacity from about 1 to about 5 cN/Dtex. In some embodiments, the polyethylene may have a tenacity from about 2 to about 4 cN/Dtex. In further embodiments, the polyethylene may have a tenacity of about 2.34 cN/Dtex. As such, in certain embodiments, the polyethylene may have a tenacity from at least about any of the following: 1, 1.5, 2, 2.5, 3, 3.5, 4, and 4.5 cN/Dtex and/or at most about 5, 4.5, 4, 3.5, 3, 2.5, 2, and 1.5 cN/Dtex (e.g., from about 2-3 cN/Dtex, from about 1.5-4 cN/Dtex, etc.).

According to certain embodiments, the plurality of face yarns 106, 108 may comprise from about 10 to about 50 wt % recycled polyester. In some embodiments, the plurality of face yarns 106, 108 may comprise from about 25 to about 35 wt % recycled polyester. As such, in certain embodiments, the plurality of face yarns 106, 108 may comprise from at least about any of the following: 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, and 49 wt % recycled polyester and/or at most about 50, 49, 48, 47, 46, 45, 44, 43, 42, 41, 40, 39, 38, 37, 36, 35, 34, 33, 32, 31, 30, 29, 28, 27, 26, 25, 24, 23, 22, 21, 20, 19, 18, 17, 16, 15, 14, 13, 12, and 11 wt % recycled polyester (e.g., from about 15-44 wt % recycled polyester, from about 20-32 wt % recycled polyester, etc.).

According to certain embodiments, the plurality of face yarns 106, 108 may comprise from about 10 to about 60 wt % nylon. In some embodiments, the plurality of face yarns 106, 108 may comprise from about 35 to about 55 wt % nylon. As such, in certain embodiments, the plurality of face yarns 106, 108 may comprise from at least about any of the following: 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, and 59 wt % nylon and/or at most about 60, 59, 58, 57, 56, 55, 54, 53, 52, 51, 50, 49, 48, 47, 46, 45, 44, 43, 42, 41, 40, 39, 38, 37, 36, 35, 34, 33, 32, 31, 30, 29, 28, 27, 26, 25, 24, 23, 22, 21, 20, 19, 18, 17, 16, 15, 14, 13, 12, and 11 wt % nylon (e.g., from about 15-44 wt % nylon, from about 20-32 wt % nylon, etc.).

The recyclable cooling fabric 100 also includes a plurality of inlay yarns 110 disposed between the first surface 102 and the second surface 104. The inlay yarns, or inlay, may also be referred to as a stuffer, as understood by a person of ordinary skill in the art. As shown in FIG. 1, the plurality of inlay yarns 110 may be knit between the plurality of face yarns 106, 108 making up the first and second surfaces 102, 104 respectively; however, the plurality of inlay yarns 110 may be disposed between the first and second surfaces 102, 104 by any suitable means as understood by a person of ordinary skill in the art.

According to certain embodiments, the plurality of inlay yarns 110 may comprise at least one of virgin polyester, recycled polyester, wool, polyethylene, or any combination thereof. In some embodiments, for example, the plurality of inlay yarns 110 may comprise virgin polyester, recycled polyester, or any combination thereof. As with the plurality of face yarns 106, 108, the plurality of inlay yarns 110 may comprise individual virgin polyester, recycled polyester, wool, and/or polyethylene yarns, or the plurality of inlay yarns 110 may comprise a blend of two or more of virgin polyester fibers, recycled polyester fibers, wool fibers, and/or polyethylene fibers. In this way, the plurality of inlay yarns 110 may include yarns made only of one type of fiber (e.g., virgin polyester, recycled polyester, wool, or polyethylene), yarns made of multiple types of fibers (e.g., virgin polyester and recycled polyester fibers, virgin polyester and wool fibers, virgin polyester and polyethylene fibers, recycled polyester and wool fibers, recycled polyester and polyethylene fibers, wool and polyethylene fibers, virgin polyester, recycled polyester and wool fibers, virgin polyester, recycled polyester, and polyethylene fibers, recycled polyester, wool, and polyethylene fibers, or virgin polyester, recycled polyester, wool, and polyethylene fibers), or some combination thereof.

According to certain embodiments, the recyclable cooling fabric 100 may comprise from about 20 to about 50 wt % of the plurality of inlay yarns 110. As such, in some embodiments, the recyclable cooling fabric 100 may comprise from at least about any of the following: 20, 21, 22, 23, 24, 25, 26, 27, 28, 29, 30, 31, 32, 33, 34, 35, 36, 37, 38, 39, 40, 41, 42, 43, 44, 45, 46, 47, 48, and 49 wt % of the plurality of inlay yarns 110 and/or at most about 50, 49, 48, 47, 46, 45, 44, 43, 42, 41, 40, 39, 38, 37, 36, 35, 34, 33, 32, 31, 30, 29, 28, 27, 26, 25, 24, 23, 22, and 21 wt % of the plurality of inlay yarns 110 (e.g., from about 24-42 wt %, from about 30-50 wt %, etc.).

According to certain embodiments, the recyclable cooling fabric 100 may comprise a three-part knit (i.e. having a fabric face (e.g., the first surface 102), a fabric back (e.g., the second surface 104), and an inlay or stuffer (e.g., the plurality of inlay yarns 110)). In some embodiments, the recyclable cooling fabric 100 may comprise a jacquard knitted fabric.

Figure 2:
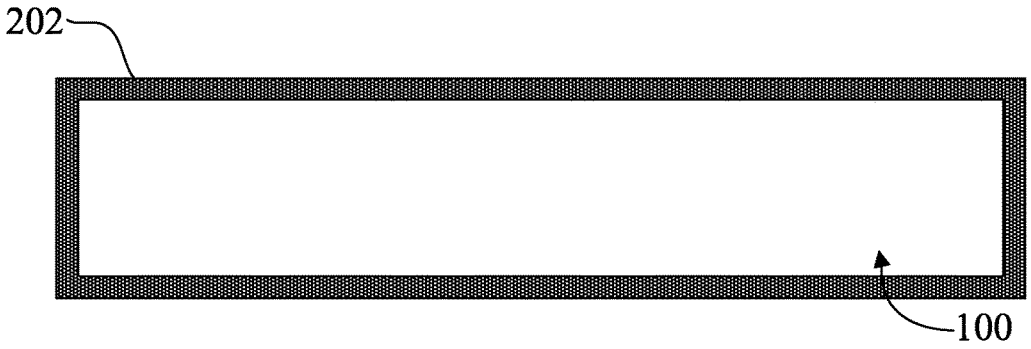
FIG. 2 illustrates a cross-section of a coated recyclable cooling fabric in accordance with certain embodiments of the invention.

According to certain embodiments, and as illustrated in FIG. 2, the recyclable cooling fabric 100 may further comprise a phase change material 202 coated on at least one of the first surface 102 and the second surface 104 of the recyclable cooling fabric 100. For example, as shown in FIG. 2, the phase change material 202 is coated on both the first surface 102 and the second surface 104 of the recyclable cooling fabric 100, but this disclosure is not so limited. In some embodiments, the phase change material 202 may be any organic phase change material. In further embodiments, the phase change material 202 may be 100% formaldehyde free. For example, the phase change material 202 may comprise at least one of lauric acid, a trimethylolethane/water mixture, a paraffin (e.g., paraffin 14-carbons, paraffin 15-carbons, paraffin 16-carbons, paraffin 17-carbons, paraffin 18-carbons, paraffin 19-carbons, paraffin 20-carbons, paraffin 21-carbons, paraffin 22-carbons, paraffin 23-carbons, paraffin 24-carbons, paraffin 25-carbons, paraffin 26-carbons, paraffin 27-carbons, paraffin 28-carbons, paraffin 29-carbons, paraffin 30-carbons, paraffin 31-carbons, paraffin 32-carbons, paraffin 33-carbons, paraffin 34-carbons), formic acid, caprylic acid, glycerin, polylactic acid, methyl palmitate, camphenilone, dodecyl bromide, caprylone, phenol, heptadecanone, cyclohexyl-octadecane, p-toluidine, cyanamide, methyl eicosanoate, hydrocinnamic acid, cetyl alcohol, a-napthylamine, camphene, o-nitroaniline, thymol, methyl behenate, diphenyl amine, p-dichlorobenzene, oxalate, hypophosphoric acid, xylene dichloride, chloroacetic acid, nitronaphthalene, trimyristin, heptadecanoic acid, beeswax, glycolic acid, p-bromophenol, azobenzene, acrylic acid, dinitrotoluene, phenylacetic acid, thiosinamine, bromocamphor, durene, methyl bromobenzoate, a-naphthol, glutaric acid, catechol, quinone, acetanilide, succinic anhydride, benzoic acid, stilbene, benzamide, acetic acid, polyethylene glycol, capric acid, elaidic acid, pentadecanoic acid, tristearin, myristic acid, palmitic acid, stearic acid, acetamide, methyl fumarate, or any combination thereof.

According to certain embodiments, the recyclable cooling fabric 100 may comprise from about 5 to about 30 wt % of the phase change material 202. As such, in certain embodiments, the recyclable cooling fabric 100 may comprise from at least about any of the following: 5, 6, 7, 8, 9, 10, 11, 12, 13, 14, 15, 16, 17, 18, 19, 20, 21, 22, 23, 24, 25, 26, 27, 28, and 29 wt % of the phase change material 202 and/or at most about 30, 29, 28, 27, 26, 25, 24, 23, 22, 21, 20, 19, 18, 17, 16, 15, 14, 13, 12, 11, 10, 9, 8, 7, and 6 wt % of the phase change material 202 (e.g., from about 8-25 wt %, from about 15-30 wt %, etc.).

According to certain embodiments, the recyclable cooling fabric 100 may have a thermal effusivity from about 85 to about 1600 $Ws^{1/2}/m^2K$. In some embodiments, the recyclable cooling fabric 100 may have a thermal effusivity from about 135 to about 285 $Ws^{1/2}/m^2K$. As such, in certain embodiments, the recyclable cooling fabric 100 may have a thermal effusivity from at least about any of the following: 85, 90, 95, 100, 105, 110, 115, 120, 125, 130, 135, 140, 145, 150, 155, 160, 165, 170, 175, 180, 185, 190, 195, 200, 205, 210, 215, 220, 225, 230, 235, 240, 245, 250, 255, 260, 265, 270, 275, 280, 285, 290, 295, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1555, 1560, 1565, 1570, 1575, 1580, 1585, 1590, and 1595 $Ws^{1/2}/m^2K$ and/or at most about 1600, 1595, 1590, 1585, 1580, 1575, 1570, 1565, 1560, 1555, 1550, 1500, 1450, 1400, 1350, 1300, 1250, 1200, 1150, 1100, 1050, 1000, 950, 900, 850, 800, 750, 700, 650, 600, 550, 500, 450, 400, 350, 300, 295, 290, 285, 280, 275, 270, 265, 260, 255, 250, 245, 240, 235, 230, 225, 220, 215, 210, 205, 200, 195, 190, 185, 180, 175, 170, 165, 160, 155, 150, 145, 140, 135, 130, 125, 120, 115, 110, 105, 100, 95, and 90 $Ws^{1/2}/m^2K$ (e.g., from about 120-285 $Ws^{1/2}/m^2K$, from about 180-1150 $Ws^{1/2}/m^2K$, etc.). Thermal effusivity, as discussed herein, is measured per ASTM D7984-16 (quantification thermal performance). The high thermal effusivity may be due, in part, to the texturing process used in the fabrication of the recycled polyester fibers.

According to certain embodiments, the recyclable cooling fabric 100 may have a fabric weight from about 200 to about 450 GSM. As such, in some embodiments, the recyclable cooling fabric 100 may have a fabric weight from at least about any of the following: 200, 205, 210, 215, 220, 225, 230, 235, 240, 245, 250, 255, 260, 265, 270, 275, 280, 285, 290, 295, 300, 305, 310, 315, 320, 325, 330, 335, 340, 345, 350, 355, 360, 365, 370, 375, 380, 385, 390, 395, 400, 405, 410, 415, 420, 425, 430, 435, 440, and 445 GSM and/or at most about 450, 445, 440, 435, 430, 425, 420, 415, 410, 405, 400, 395, 390, 385, 380, 375, 370, 365, 360, 355, 350, 345, 340, 335, 330, 325, 320, 315, 310, 305, 300, 295, 290, 285, 280, 275, 270, 265, 260, 255, 250, 245, 240, 235, 230, 225, 220, 215, 210, and 205 GSM (e.g., from about 230-310 GSM, from about 200-445 GSM, etc.).

Mattress with Recyclable Cooling Mattress Ticking

Figure 3:
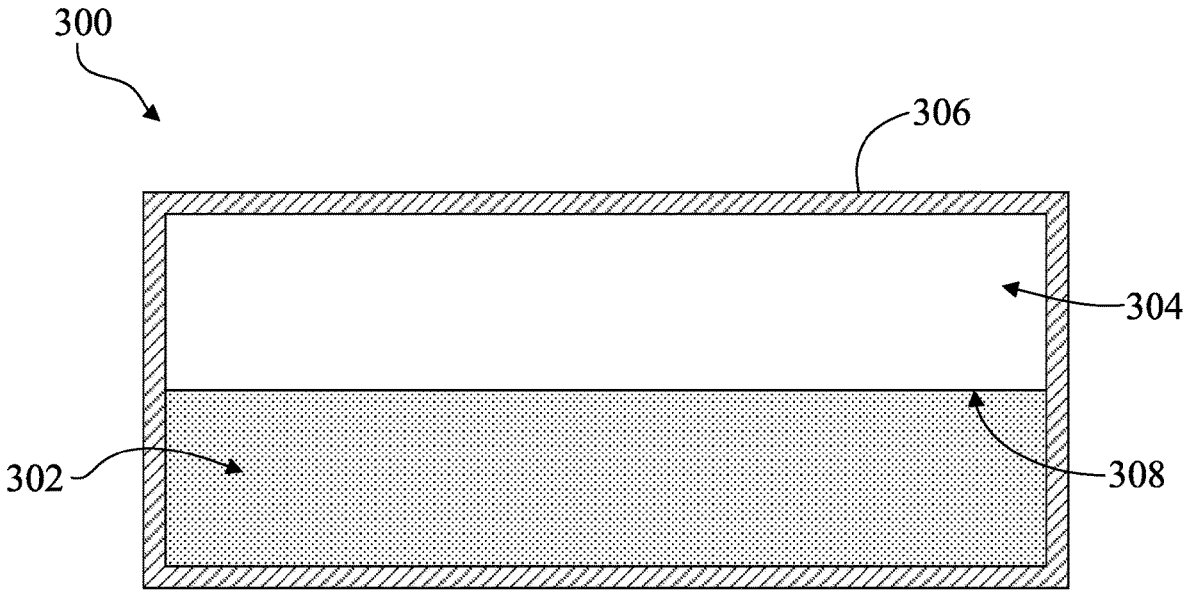
FIG. 3 illustrates a cross-section of a mattress in accordance with certain embodiments of the invention.

Referring now to FIG. 3, FIG. 3 illustrates a mattress 300 having a support layer 302, a comfort layer 304 disposed on a surface 308 of the support layer 302, and a recyclable cooling mattress ticking 306 enveloping the support layer 302 and the comfort layer 304.

According to certain embodiments, the support layer 302 may comprise one or more of pocket springs (also known as pocket coils), an innerspring (e.g., Bonnell spring support system or continuous coil spring system), a polyurethane foam, latex, and/or the like, but any suitable components may be used in the support layer 302 as understood by a person of ordinary skill in the art.

According to certain embodiments, the comfort layer 304 may comprise one or more of polyethylene terephthalate (e.g., DACRON®), polyurethane foam, viscoelastic memory foam, wool (either alone or blended with cotton-wool or polyethylene terephthalate), latex, gel (either as a pad or particles infused into a viscoelastic material), and/or the like, but any suitable components may be used in the comfort layer 304 as understood by a person of ordinary skill in the art.

According to certain embodiments, the recyclable cooling mattress ticking 306 may be made of the same construction as the recyclable cooling fabric 100 discussed previously herein. For example, as with the recyclable cooling fabric 100, the recyclable cooling mattress ticking 306 includes a first surface 102 and a second surface 104, as shown in FIG. 1. As also shown in FIG. 1, the first surface 102 and the second surface 104 comprise a plurality of face yarns 106, 108. The plurality of face yarns 106, 108 comprises polyethylene, nylon, and recycled polyester. The recyclable cooling mattress ticking 306 also includes a plurality of inlay yarns 110 disposed between the first surface 102 and the second surface 104, as further illustrated in FIG. 1.

As also previously described herein with regard to the recyclable cooling fabric 100 and as illustrated in FIG. 2, the recyclable cooling mattress ticking 306 may further comprise a phase change material 202 coated on at least one of the first surface 102 and the second surface 104 of the recyclable cooling mattress ticking 306.

Method of Manufacturing Recyclable Cooling Fabric

Figure 4:
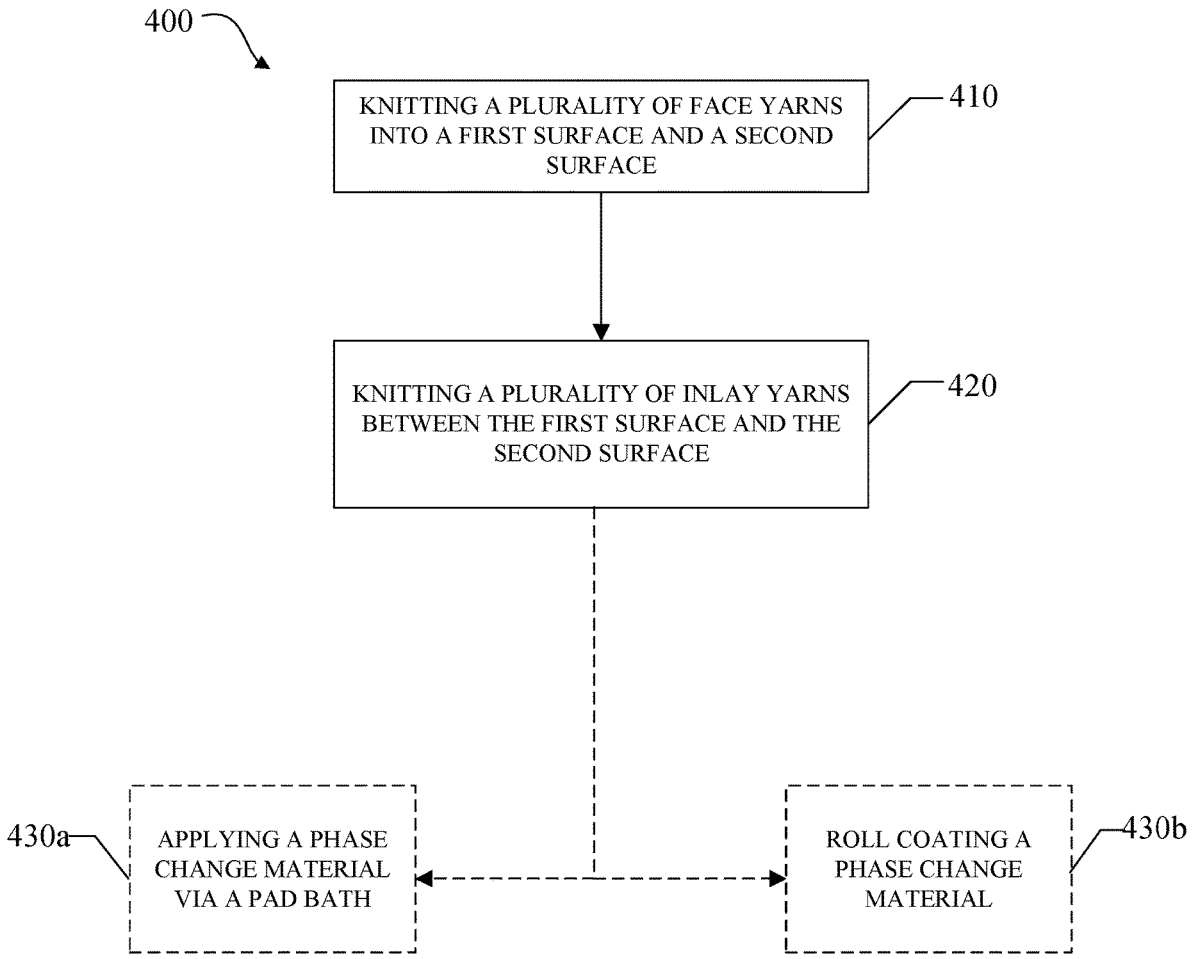
FIG. 4 is a block diagram of a method of manufacturing a recyclable cooling fabric in accordance with certain embodiments of the invention.

Referring now to FIG. 4, FIG. 4 is a block diagram illustrating a method 400 for manufacturing a recyclable cooling fabric. As shown in block 410, the method 400 may begin with knitting a plurality of face yarns into a first surface and a second surface. As shown in block 420, the method 400 may continue with knitting a plurality of inlay yarns between the first surface and the second surface.

As shown in block 430*a*, the method 400 may optionally include applying a phase change material via a pad bath (i.e. via total immersion of the recyclable cooling fabric in a trough bath containing the phase change material). In addition or the alternative, as shown in block 430*b*, the method 400 may optionally roll coating a phase change material (i.e. using a series of rollers to meter and apply a coating). For example, in some embodiments, the phase change material may be applied to the recyclable cooling fabric at a temperature from about 200-260° F. In further embodiments, the phase change material may be applied to the recyclable cooling fabric at a speed range from about 10 ypm to about 25 ypm. While the use of a pad bath or roll coating is discussed herein for application of the phase change material, a person of ordinary skill in the art would understand that one or more of any suitable application methods may be used in addition or in the alternative.

Modifications of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A recyclable cooling fabric comprising:

a first surface and a second surface opposite the first surface, the first surface and the second surface comprising a plurality of face yarns, the plurality of face yarns comprising polyethylene, nylon, and recycled polyester; and a plurality of inlay yarns disposed between the first surface and the second surface.

2. The recyclable cooling fabric of claim 1, wherein the plurality of inlay yarns comprise at least one of virgin polyester, recycled polyester, wool, polyethylene, or any combination thereof.

3. The recyclable cooling fabric of claim 1, wherein the recyclable cooling fabric comprises from about 20 to about 50 wt % of the plurality of inlay yarns.

4. The recyclable cooling fabric of claim 1, wherein the recyclable cooling fabric comprises from about 20 to about 50 wt % of the plurality of face yarns.

5. The recyclable cooling fabric of claim 1, further comprising a phase change material coated on at least one of the first surface and the second surface of the recyclable cooling fabric.

6. The recyclable cooling fabric of claim 1, wherein the recyclable cooling fabric comprises a three-part knit.

7. The recyclable cooling fabric of claim 1, wherein the recyclable cooling fabric comprises a jacquard knitted fabric.

8. The recyclable cooling fabric of claim 1, wherein the recyclable cooling fabric has a thermal effusivity from about 85 to about 1600 $Ws^{1/2}/m^2K$.

9. The recyclable cooling fabric of claim 1, wherein the recyclable cooling fabric has a thermal effusivity from about 135 to about 285 $Ws^{1/2}/m^2K$.

10. The recyclable cooling fabric of claim 1, wherein the recyclable cooling fabric has a fabric weight from about 200 to about 450 GSM.

11. A method of manufacturing a recyclable cooling fabric, the method comprising:

knitting a plurality of face yarns into a first surface and a second surface opposite the first surface, the plurality of face yarns comprising polyethylene, nylon, and recycled polyester; and knitting a plurality of inlay yarns between the first surface and the second surface.

12. The method of claim 11, further comprising coating a phase change material on at least one of the first surface and the second surface.

13. The method of claim 12, wherein coating the phase change material comprises applying the phase change material via a pad bath.

14. The method of claim 12, wherein coating the phase change material comprises roll coating the phase change material.

15. The method of claim 11, wherein knitting the plurality of face yarns and knitting the plurality of inlay yarns comprises a three-part knit.

16. The method of claim 11, wherein knitting the plurality of face yarns and knitting the plurality of inlay yarns comprises a jacquard knit.

17. The method of claim 11, wherein the recyclable cooling fabric comprises from about 20 to about 50 wt % of the plurality of inlay yarns and from about 20 to about 50 wt % of the plurality of face yarns.

18. The method of claim 11, wherein the recyclable cooling fabric has a thermal effusivity from about 135 to about 285 $Ws^{1/2}/m^2K$.

19. A mattress comprising:

a support layer;

a comfort layer disposed on a surface of the support layer; and a recyclable cooling mattress ticking enveloping the support layer and the comfort layer, the recyclable cooling mattress ticking comprising:

a first surface and a second surface opposite the first surface, the first surface and the second surface comprising a plurality of face yarns, the plurality of face yarns comprising polyethylene, nylon, and recycled polyester; and a plurality of inlay yarns disposed between the first surface and the second surface.

20. The mattress of claim 19, wherein the recyclable cooling mattress ticking further comprises a phase change material coated on at least one of the first surface and the second surface.

* * * * *